United States Patent [19]

Morgan et al.

[11] 4,349,341

[45] Sep. 14, 1982

[54] VANE STEERING SYSTEM FOR MARINE DRIVES

[75] Inventors: Edward J. Morgan, Fond du Lac; Neil A. Rohan, Menasha, both of Wis.

[73] Assignee: Brunswick Corporation, Skokie, Ill.

[21] Appl. No.: 106,833

[22] Filed: Dec. 26, 1979

[51] Int. Cl.[3] ..... B63H 21/26

[52] U.S. Cl. ..... 440/51; 440/62

[58] Field of Search ..... 440/51, 63, 62, 900; 144/144 R, 162, 160, 150, 146

[56] References Cited

U.S. PATENT DOCUMENTS

| | | | |
|---|---|---|---|
| 2,787,235 | 2/1957 | Schroeder | 114/150 |
| 2,899,833 | 8/1959 | Prier | 114/146 X |
| 2,993,464 | 7/1961 | Conover | 440/51 |
| 3,149,605 | 9/1964 | Broadwell | 440/51 |
| 3,943,878 | 3/1976 | Kirkwood et al. | 114/144 R X |

*Primary Examiner*—Sherman D. Basinger

*Attorney, Agent, or Firm*—Andrus, Sceales, Starke & Sawall

[57] ABSTRACT

A marine drive has a high aspect ratio, counterbalanced vane on the propulsion unit for generating hydrodynamic torque when rotated. Control cables fastened to a bar on the vane post extend to the rear end of a lever mounted on the steering arm of the marine drive. The forward end of the lever receives the control rod of the boat steering mechanism. Movement of the control rod moves the lever, pulling one or the other control cable and rotating the vane. The lever is so mounted on the steering arm that movements of the control rod are magnified in operating the control cables. Vane rotation may be used to counteract propeller torque components causing course deviations to the boat and to provide torque for turning the marine drive.

13 Claims, 8 Drawing Figures

VANE STEERING SYSTEM FOR MARINE DRIVES

The present invention relates to marine drives and particularly concerns a movable vane for steering.

U.S. Pat. No. 2,993,464 to Conover describes steering an outboard engine by rotating a trim tab. The hydrodynamic forces generated upon rotating the trim tab turn the outboard engine. To steer the boat in a counterclockwise direction, that is, to swing the bow to the left or to port, the outboard engine is turned in the clockwise direction by turning the trim tab counterclockwise. In one embodiment, the trim tab is connected directly to the cables used to steer the engine. In another embodiment, a lever mechanism is employed which operates from a movable tiller connected to the engine. The first embodiment is limited to two-cable steering, which to a great extent has been replaced by other steering units. The second embodiments, which employs a lever mechanism, is complex and compressive failure or buckling of the elongated levers may occur.

U.S. Pat. No. 3,943,878 to Kirkwood, et al, uses a flexible control cable to turn the trim tab. This unit also has the problem of compressively stressing the control mechanism when moving the trim tab in one direction.

U.S. Pat. No. 3,149,605 to Broadwell illustrates the use of two flexible cables under tension, each connected to a steering tab. The cables are actuated by a link having one end pivotally mounted on the engine and the other end connected to the boat steering mechanism. The cables are mounted in the center of the link so that only a selected one of the two is actuated when the link is pivoted in a given direction. Each cable moves one of the trim tabs but not the other. This approach is complex and expensive.

It is an object of the present invention to provide a marine drive steering system by which the enhanced operation and control obtainable through the use of a rotatable steering vane may be fully realized.

The steering system of the present invention includes a partially counterbalanced steering vane mounted on the marine drive unit for generating hydrodynamic torque on the unit when the vane is rotated with respect to the drive unit. The vane is deep with a, high aspect ratio for improved operating control at all marine drive tilt angles. A vane rotating member, formed as a bar, is mounted on the vane post. The end of a vane control cable is attached to each extremity of the vane rotating member for rotating the vane responsive to tensile forces exerted by the cables.

A lever is pivotally mounted between its ends to the steering arm of the marine drive with the forward end of the lever receiving the steering control element of the boat. The control cables extend along either side of the drive unit and the other ends of the control cables are attached to the rear end of the lever. Movement of the lever by the steering control element generates a vane rotating tensile force in the appropriate control cable required to rotate the vane in the direction necessary for a desired steering maneuver of the boat or to counteract course deviating propeller torque components. A coordinated release is provided in the other control cable. Only tensile forces are thus used to effect a rotation of the vane.

Importantly, movement magnification is provided in the lever so that movements of the steering control element are magnified in operating the cables. This reduces the effects of slack in the control cables on rotational control of the vane. The movement magnification may preferably be provided by positioning the pivot point of the lever closer to its forward end than its rear end.

The steering system includes stops for limiting the pivotal movement of the lever with respect to the steering arm to a predetermined amount and for thereafter coupling for steering control element to the steering arm to directly turn the drive unit. Because of the movement magnification obtained by the lever, the play introduced into the steering system by the lever may be minimized.

Figure 1:
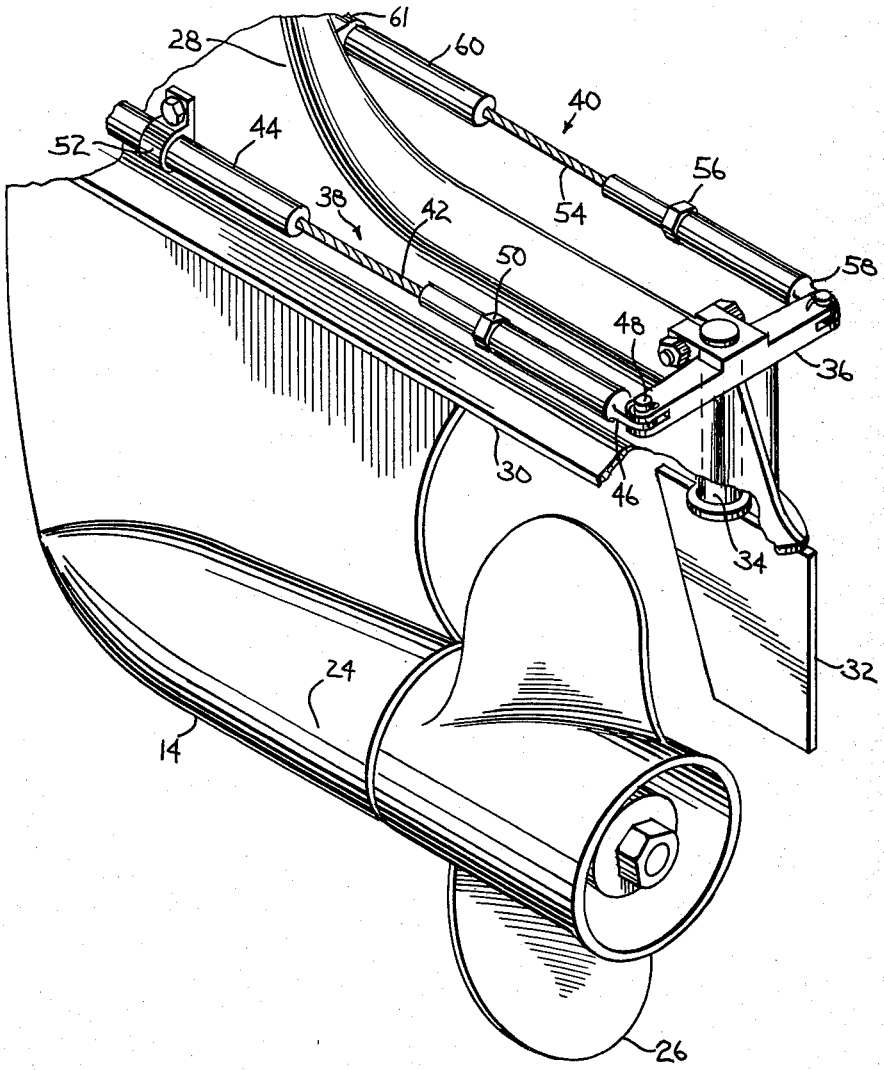
FIG. 1 is a perspective view of a drive unit of a steerable marine drive showing the vane employed in the steering system of the present invention.
Figure 2:
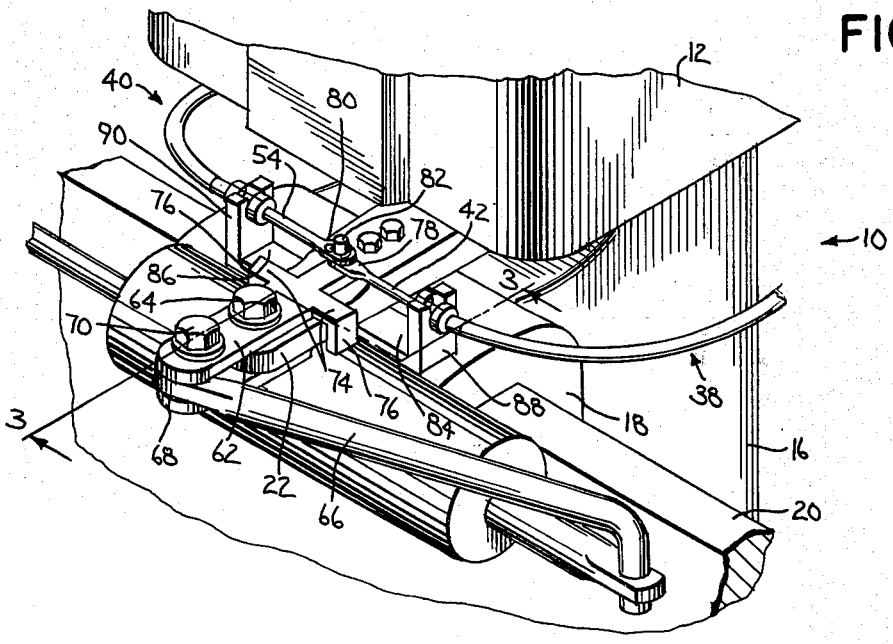
FIG. 2 is a perspective view of the upper portions of a marine drive of the outboard type showing the steering arm and additional portions of the steering system of the present invention.

FIGS. 1 and 2 illustrate an outboard motor 10. Outboard motor 10 includes engine 12 and a drive unit 14. The outboard motor 10 is pivotally mounted on bracket 18 which may be removably clamped to the transom 20 of a boat. Steering arm 22 extends from motor 10 for turning the engine with respect to bracket 18 and transom 20. The present invention may also be used with marine stern drive in which only drive unit 14 is mounted on the exterior of the transom.

As shown more clearly in FIG. 1, drive unit 14 includes gear case 24 containing gears connecting the engine drive shaft to the shaft for propeller 26. Streamlined extension 28 of drive unit 14 terminates in anti-cavitation plate 30.

Figure 4:
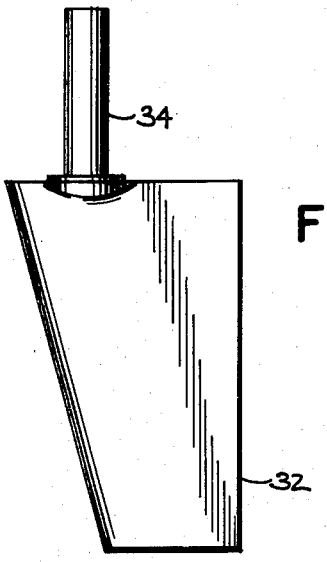
FIG. 4 is a side view showing details of a steering vane suitable for use in the steering system of the present invention.

Steering vane 32 is mounted on propulsion unit 14 rearwardly of propeller 26 and below anti-cavitation plate 30 to extend into the slip stream produced by the propeller. Vane 32 includes a post 34 journalled in streamlined extension 28. Post 34 is connected to vane 32 so that the center of pressure of the steering vane is behind the axis of rotation of the steering vane. The vane is partially counterbalanced by having some of the blade ahead of the axis of rotation of the steering vane. Placement of the center or pressure behind the axis of rotation provides hydrodynamic stability to vane 32 while at the same time requiring a level of operating torque sufficient to provide a desired degree of feel to the steering system, as hereinafter described. Vane 32 is preferably constructed with a high aspect ratio, most preferably with an aspect ratio greater than 1, as shown in FIG. 4. The aspect ratio refers to the ratio between the length and the chord of the vane and is ascertained by dividing its length parallel to the axis of rotation by its average chord or width. A deep vane assists in retaining the vane in the slip stream at large tilt angles between the propulsion unit and the transom and the high aspect ratio improves the hydrodynamic efficiency of the vane.

Vane rotating bar 36 has the central portion fixed to the upper extension of vane post 34. A pair of control cables 38 and 40 are connected to the ends of bar 36. Control cable 38 includes central core 42 carried in surrounding sheath 44. The end of core 42 is secured to clevis 46 which receives the end of bar 36 as well as retaining pin 48. An adjuster 50 is provided intermediate the end of core 42 and clevis 46 to take up slack in cable 38. The sheath 44 for cable 38 is secured to housing 28 by clamp 52. Control cable 40 is formed in a similar manner to control cable 38 to include central core 54 fastened through adjuster 56 and clevis 58 to the other end of bar 36 and surrounding sheath 60 secured to housing 28 by a clamp 61. Control cables 38 and 40 each extend along one side of engine 10 into proximity with steering arm 22, shown in greater detail in FIGS. 2, 3, and 5.

Figure 3:
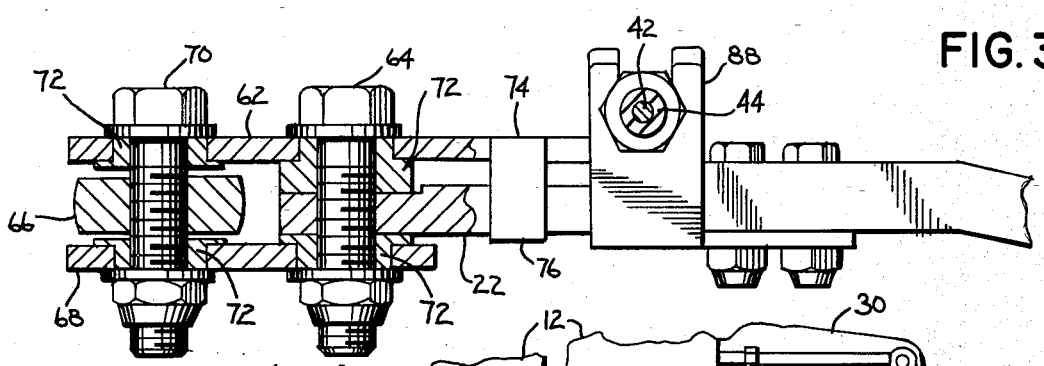
FIG. 3 is a partial cross-sectional view taken along the line 3—3 of FIG. 2 and showing further details of the steering system.

Lever 62 is pivotally mounted intermediate its ends on the forward end of steering arm 22 by bolt 64, as shown in FIGS. 2 and 3. The forward end of lever 62 receives the control rod 66 of the steering mechanism for the boat. To assist in connecting control rod 66, link 68, formed similarly to the end of the lever 62, is positioned beneath lever 62. Link 68 receives bolt 64 extending through steering arm 22 and bolt 70 which extends through lever 62 and control rod 66. See FIG. 3. Preferably, bushings 72 are provided for bolts 64 and 70. While a control rod 66 is shown for exemplary purposes in the figures, it will be appreciated that other means, such as cables, may be used to steer the boat.

Figure 5:
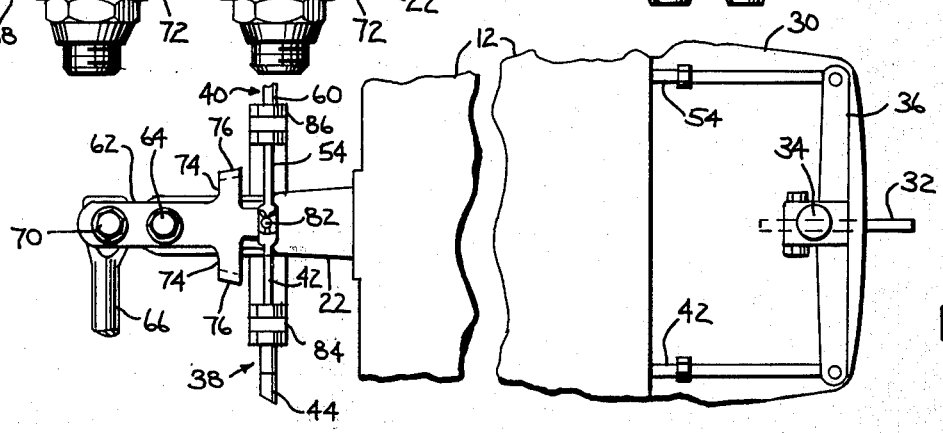
FIG. 5 is a plan view of the steering system of the present invention showing the proportions of certain elements.
Figure 8:
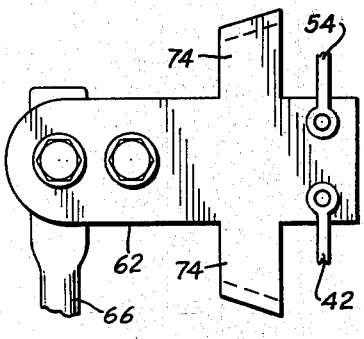
FIG. 8 is a fragmentary plan view showing a modification of the lever element of the steering system.

The rear end of lever 62 receives cores 42 and 54 of control cables 38 and 40, as shown in FIGS. 2 and 5. For this purpose, the ends of cores 42 and 54 contain eyes 78 and 80 which are pinned to lever 62 by pin 82. While FIGS. 2 and 5 show cores 42 and 54 attached to a common pin 82 which lies on the input axis of lever 62 formed by the location of bolts 70 and 64 in the lever, it will be appreciated that separate attachment points displaced from the axis may be utilized, if desired as shown in FIG. 8. Steering arm 22 includes brackets 84 and 86 spaced from the arm having extensions 88 and 90 for anchoring the sheaths 44 and 60 of control cables 38 and 40, respectively. The rearward extension of lever 62 contains a pair of laterally extending arms 74 intermediate bolt 64 and the rear end of the lever. Arms 74 terminate in tabs 76 which extend downwardly along the sides of steering arm 22 to form stops for the pivotal movement of lever 62.

Lever 62 is pivotally mounted on steering arm 22 so that the distance between the point of fastening control cable cores 42 and 54 and the pivot point formed by bolt 64 is greater than the distance between the pivot point and the point at which control rod 66 is fastened to the lever. It has been determined that a very practical distance ratio is 2:1. This length ratio causes a 2:1 movement magnification in lever 62 so that movements of the lever by control rod 66 when applied to cables 38 and 40 are magnified by a factor of 2. The movement magnification provides the increased movement to the cables necessary to minimize the effects of slack and thereby enhance the operation of the steering system.

To describe the operation of the steering system of the present invention, it is assumed that water is flowing past the vane at a speed sufficient to generate the desired hydrodynamic forces on vane 32 and that in the initial condition drive unit 14 is generally perpendicular to transom 20. It is now desired to steer the boat to the left or port; that is, swing the bow in a counterclockwise direction. To initiate this turn, the steering control for the boat is operated to move control rod 66 in a direction which would pivot engine 10 in the clockwise direction.

This movement of control rod 66 pivots lever 62 in the clockwise direction, generating an increased tensile force in core 54 of the control cable 40, or a decreased tensile force in core 42 of the control cable 38, thus pulling vane rotating bar 36 and vane 32 counterclockwise. Counterclockwise rotation of vane 32 generates a hydrodynamic force in the port direction and thus turns drive unit 14 in a clockwise direction. The desired counterclockwise alteration of the course of the boat is thus obtained. To turn engine 10 in the opposite direction, the movement of the various elements is reversed.

When engine 10 is driving the boat straight ahead, there are forces and torques acting on the propeller so as to cause a torque on the drive unit about the steering axis. With the system of the present invention, vane 32 will automatically position itself so as to largely counter-balance the torque about the steering axis and thus greatly reduce the required load in control rod 66.

Under normal operating conditions, the pivotal movements of the lever on steering arm 22 are ordinarily rather small. Under most operation conditions, motion of the steering wheel, control rod, control cable core, vane, and drive unit are closely in phase with little or no observable time lag. Only infrequently will lever 62 be displaced to the limits of its pivotal movement on steering arm 22 established when one of tabs 76 strikes steering arm 22. This condition may occur when the boat is moving so slowly that insufficient hydrodynamic forces are generated on vane 32 to turn engine 10. It may also occur if control rod 66 is moved faster than engine 10 can follow with a responsive turning action. When lever 62 is rotated until tab 76 strikes steering arm 22, movements of control rod 66 are transmitted directly to steering arm 22 to turn drive unit 14. Steering vane 32 is placed in the maximum rotated position to assist in the turning of drive unit 14. Tabs 76 on arms 74 are mounted at an angle so as to abut the sides of steering arm 22 along their entire length.

While the steering system of the present invention can provide a substantial reduction in the forces required to turn marine drive 10 and steer the boat, it may be desirable to provide some steering feel in the system. This reduces any sudden surprise experienced by the driver if the vane steering system fails and the steering of the boat is converted to that obtained through the coupling of control rod 66 to steering arm 22 by the tabs 76 on lever 62. It also enables the driver to alter the forces in the steering system to a desired level in the conventional manner by trimming the motor; that is, adjusting the tilt angle of the motor. If desired, the steering forces may be reduced to almost zero by adjusting the tilt angle. In establishing the amount of force in the steering system it is necessary to give coordinated consideration to three factors; the amount of counterbalancing of steering vane 32, the length of bar 36, and the point at which lever 62 is pivoted on steering arm 22.

In addition to force considerations, it is necessary to consider the amount of movement occurring in the system. It is desirable to limit the angular motion of steering vane 32 to approximately 15° either side of the center position in order to avoid a loss of effectiveness through cavitation and venting. It is also desirable to minimize the pivotal movement of the forward end of lever 62 so that there is not excessive slack in the system should the vane steering system fail. However, it is desirable to have as large a motion of control cables 38 and 40 as possible, so as to minimize the effect of slack in the cables or fittings and of deformation or internal wear in the cables resulting from use.

In meeting desired force and movement criteria, it has been found advantageous to form stops 76 on lever 62 so that the forward end of lever 62 can move about ¼" either side of the centered position. This provides a total play to lever 62 of ½". As previously noted, lever 62 is preferably pivotally mounted on steering arm 22 to provide a 2:1 movement magnification in the lever.

The 2:1 movement magnification in lever 62 moves cable cores 42 and 54 ½" in either direction from the center position. Bar 36 is made approximately 6" long. The ½" movement exerted by the cables 38 and 40 over the 2 half arm length of bar 36 rotates vane 32 approximately 15°.

Figure 7:
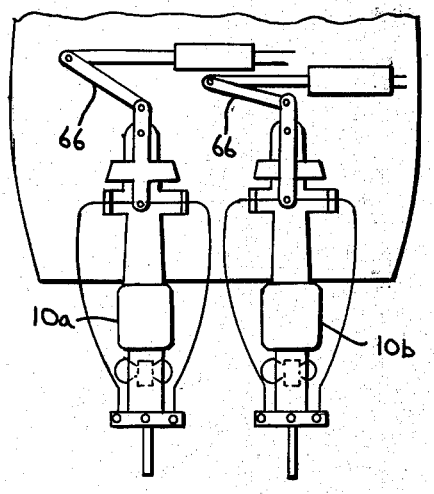
FIGS. 6 and 7 are diagrammatic views showing use of the invention in multi-engine installations.
Figure 6:
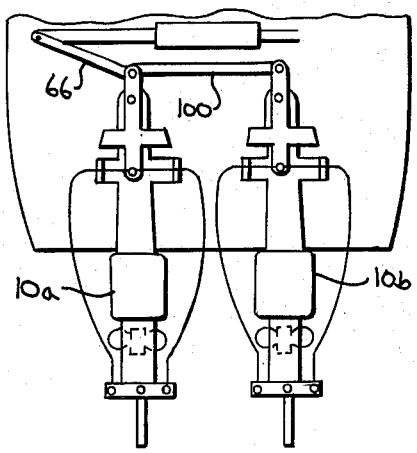

As shown in FIGS. 6 and 7, the steering system of the present invention may be used in multi-engine installations. A single control rod 66 may be used and the marine drives 10*a* and 10*b* coupled together by tie rod 100 as shown in FIG. 6. Or dual control rods 66 may be used, either without a tie rod, as shown in FIG. 7, or with a tie rod in a manner analogous to FIG. 6.

We claim:

1. In a steering apparatus for a steerable marine drive, including a drive unit pivotally mounted on the transom of a boat for moving and steering the boat through the water, a steering arm means operatively associated with the drive unit for pivoting the drive unit, and a movable steering control means for the boat, wherein an improved steering system comprises:

a steering vane rotatably mounted on the drive unit for generating a hydrodynamic torque on the drive unit upon rotation of said vane with respect to the drive unit;

a vane rotating member coupled to said vane for rotating said vane responsive to tensile forces exerted thereon;

a pair of vane control cable means, each having a movable element with a first end and a second end, said first end being attached to said vane rotating member for exerting vane rotating tensile forces on said member by the movement of said element; and a lever pivotally mounted on said steering arm means at a pivot point on said lever intermediate the ends of the lever, said lever having a forward lever arm extending in one direction from said pivot point toward one end of said lever, said forward lever arm receiving the steering control means, said lever having at least one rear lever arm extending from said pivot point in the opposite direction from said forward lever arm toward the other end of said lever, said rear lever arm being attached to the second ends of said control cable means elements for coordinately moving said elements to generate a tensile force in one of said control cable means elements and a release in the other control cable means element responsive to the movement of said lever by the steering control means, said lever pivot point being positioned intermediate the ends of the lever closer to the forward end than the rear end so as to provide a magnification of about 2:1 between the movement of the steering control means and the resulting magnified movement of the elements of said cable control means, said lever having means for limiting its pivotal movement with respect to the steering arm means to a predetermined amount and for coupling the steering control means to the steering arm means to move the steering arm means directed from the steering control means when the lever has reached the limit of pivotal movement.

2. The steering system according to claim 1 wherein said lever includes one rear lever arm attached to both second ends of said control cables.

3. The steering system according to claim 2 wherein said second ends of said control cable means elements are attached to a substantially common point on the rear end of said lever.

4. The steering system according to claim 3 wherin said forward end of said lever and the pivot point of said lever form an input axis for said lever and wherein said common attachment point for said second ends of said control cable means element lies along said input axis.

5. The steering system according to claim 1 wherein said lever includes two rear attachment points for the second ends of said control cables.

6. The steering system according to claim 1 wherein said forward end of said lever and the pivot point of said lever form an input axis therefor and wherein the attachment of said second ends of said control cable means elements to the rear lever arm of said lever is displaced from the input axis of said lever.

7. The steering system according to claim 1 wherein the pivotal movement limiting means is so formed as to limit play in the steering system to a predetermined amount while providing the necessary movement to said movable cable control means elements.

8. The steering system according to claim 1 wherein said steering vane has an aspect ratio greater than one.

9. The steering system according to claim 1 wherein the rotatable mounting of said steering vane is such that the vane is a partially counterbalanced vane.

10. The steering system according to claims 1, 3, or 6 wherein one of said control cable means extends along each side of the propulsion unit and is attached to a corresponding side of said vane rotating member and of said rear end of said lever.

11. The steering system according to claims 1, 2, 5 or 8 wherein said vane rotating member is a bar having its center coupled to said steering vane for rotating same and wherein the length of said bar is selected to provide the desired amount of rotation of said vane from the movement of said cable control means elements.

12. The steering system according to claim 11 wherein the length of said bar and amount of movement of said cable control means elements is such as to provide about 15° to said steering vane either side of a centered position.

13. The steering system according to claims 1, 2, or 5 wherein the steerable marine drive includes a plurality of drive units each of which has an improved steering system connected with steering control means.

* * * * *